US012114724B2

(12) United States Patent
Yahata

(10) Patent No.: US 12,114,724 B2
(45) Date of Patent: Oct. 15, 2024

(54) SOLE STRUCTURE AND SHOES HAVING THE SAME

(71) Applicant: MIZUNO CORPORATION, Osaka (JP)

(72) Inventor: Kentaro Yahata, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 105 days.

(21) Appl. No.: 17/984,324

(22) Filed: Nov. 10, 2022

(65) Prior Publication Data

US 2023/0157407 A1 May 25, 2023

(30) Foreign Application Priority Data

Nov. 22, 2021 (JP) ..... 2021-189112

(51) Int. Cl.
*A43B 13/14* (2006.01)
*A43B 13/12* (2006.01)
*A43B 13/18* (2006.01)

(52) U.S. Cl.
CPC ..... *A43B 13/141* (2013.01); *A43B 13/127* (2013.01); *A43B 13/186* (2013.01)

(58) Field of Classification Search
CPC ... A43B 13/141; A43B 13/127; A43B 13/186; A43B 13/184; A43B 13/122; A43B 13/145; A43B 13/185; A43B 13/226; A43B 7/146; A43B 13/223; A43B 13/0042
USPC ..... D2/954, 955
See application file for complete search history.

(56) References Cited

U.S. PATENT DOCUMENTS 4,956,927 A * 9/1990 Misevich ..... A43B 13/14 36/11
5,313,718 A * 5/1994 McMahon ..... A43B 3/0042 36/31
5,768,802 A * 6/1998 Bramani ..... A43B 7/146 36/35 R (Continued)

FOREIGN PATENT DOCUMENTS

CN 209498728 U 10/2019
DE 112018000079 T5 8/2019

(Continued)

OTHER PUBLICATIONS

Yahata et al., "Sole structure and shoes using same" (translation), 2019, Clarivate Analytics, (Year: 2019).*

*Primary Examiner* — Khoa D Huynh
*Assistant Examiner* — Haley A Smith
(74) *Attorney, Agent, or Firm* — Troutman Pepper Hamilton Sanders LLP; James E. Schutz; Korbin M. Blunck

(57) ABSTRACT

A sole structure and shoes having the sole structure are provided which enable smooth cutting maneuvers or the like and stabilize a stacking state in the sole structure. An outsole has an elastic structure arranged between a base plate and a lower midsole portion in a thickness direction of a sole structure. The elastic structure includes a plurality of elastically deformable first columnar portions and at least one coupling portion for coupling the first columnar portions adjacent to each other. The elastic structure is configured such that the coupling portion couples second end portions of the first columnar portions adjacent to each other, and that the second end portions are connected, together with the coupling portion, to the lower midsole portion.

14 Claims, 14 Drawing Sheets

(56) References Cited

U.S. PATENT DOCUMENTS

| | | | | |
|---|---|---|---|---|
| 7,264,599 | B1 * | 9/2007 | Milligan | A43B 3/34 36/141 |
| 11,064,763 | B1 * | 7/2021 | Longbottom | A43B 13/223 |
| 2015/0313310 | A1 * | 11/2015 | Okamoto | A43B 7/146 36/31 |
| 2017/0105481 | A1 * | 4/2017 | Naemi | A43B 13/141 |
| 2019/0133252 | A1 | 5/2019 | Jeong et al. | |
| 2021/0015208 | A1 * | 1/2021 | Yahata | A43B 13/12 |

FOREIGN PATENT DOCUMENTS

| | | | | |
|---|---|---|---|---|
| JP | 2019-165937 | A | 10/2019 | |
| KR | 1020170022597 | A | 3/2017 | |
| WO | WO-2019181175 | A1 * | 9/2019 | A43B 13/12 |

* cited by examiner

SOLE STRUCTURE AND SHOES HAVING THE SAME

CROSS-REFERENCE TO RELATED APPLICATION

This application claims priority to Japanese Patent Application No. 2021-189112 filed on Nov. 22, 2021, the entire disclosure of which is incorporated by reference herein.

BACKGROUND

The present disclosure relates to a sole structure and a shoe having such a sole structure.

Sole structures, such as one in Japanese Unexamined Patent Application No. 2019-165937, have been proposed as sole structures applied to shoes for indoor sporting events such as badminton and table tennis.

Japanese Unexamined Patent Application No. 2019-165937 discloses a sole structure including an outsole and a midsole arranged on the upper side of the outsole. The outsole has a plate-shaped base plate arranged on a road surface side and a plurality of elastically deformable columnar portions protruding upward from the base plate and spaced apart from each other. Each of the columnar portions is arranged between the base plate and the midsole, with its lower end portion fixed to the base plate and its upper end portion fixed to a lower surface of the midsole.

SUMMARY

In games of indoor sporting events such as badminton and table tennis, players frequently perform quick movements, such as "side step" shifting in right or left direction or "cutting maneuvers" shifting in any direction not limited to right and left directions (hereinafter will be referred to as "cutting maneuvers or the like"). With regard to these cutting maneuvers or the like, there has been a demand that sole structures of the shoes applied to games of the above-described indoor sporting events assist the cutting maneuvers or the like and reduce loads on the feet or knees of a wearer (player).

In response to such a demand, the sole structure of Japanese Unexamined Patent Application No. 2019-165937 is configured such that each of the columnar portion is elastically deformed when external force is applied to the sole structure by the cutting maneuvers or the like. As a result, the above-described sole structure allows the cutting maneuvers or the like to be smoothly performed, and the cushioning properties can reduce the loads on the feet or knees of the wearer in the cutting maneuvers or the like.

However, in the sole structure of Japanese Unexamined Patent Application No. 2019-165937, the upper end portion of each of the columnar portions is independently connected to the lower surface of the midsole, and a connection region (a surface area) of each columnar portion to the lower surface of the midsole is not always sufficient. Thus, when shear stress is concentrated excessively in the connection region due to the cutting maneuvers or the like, a connection state of the upper end portion of each columnar portion and the lower surface of the midsole may be unstable, which may affect the stacking state of the midsole and the outsole. As described above, in the sole structure of Japanese Unexamined Patent Application No. 2019-165937, there is room for improvement for stabilizing the stacking state in the sole structure.

In view of the foregoing background, it is an object of the present disclosure to achieve a sole structure that enables smooth cutting maneuvers or the like and to stabilize the stacking state in a sole structure.

In order to achieve the above-described object, a first aspect of the present disclosure is directed to a sole structure for a shoe including: a first sole portion having a base plate; and a second sole portion having a lower surface facing an upper surface of the base plate, the second sole portion being stacked on the first sole portion in a thickness direction of the sole structure. The first sole portion has an elastic structure arranged between the base plate and the second sole portion in the thickness direction. The elastic structure includes a plurality of elastically deformable first columnar portions each extending along the thickness direction and spaced apart from each other in a direction perpendicular to the thickness direction, and at least one coupling portion for coupling the first columnar portions adjacent to each other. Each of the plurality of first columnar portions has a first end portion formed integrally with the base plate and a second end portion connected to the second sole portion. The elastic structure is configured such that the coupling portion couples the second end portions of the first columnar portions adjacent to each other, and that the second end portions are connected, together with the coupling portion, to the second sole portion.

In the first aspect of the present disclosure, the first sole portion of the sole structure has the elastic structure including the plurality of first columnar portions. The plurality of first columnar portions is elastically deformable in the direction perpendicular to the thickness direction of the sole structure. Thus, when an external force is applied to the sole structure due to cutting maneuvers or the like, each of the first columnar portions is elastically deformed in a predetermined direction. Internal stress generated at each of the first columnar portions by such elastic deformation is transformed into a restoring force restoring the first columnar portion to its original state. This restoring force can increase a kick force of the wearer (player) when the wearer is about to move in an arbitrary direction in the cutting maneuvers or the like. That is, the restoring force functions as a force for assisting the cutting maneuvers or the like by the wearer. Accordingly, the wearer can smoothly perform the cutting maneuvers or the like. Further, the elastic deformation of the first columnar portions increases the cushioning properties of the sole structure. Thus, loads on the feet or knees of the wearer in the cutting maneuvers or the like are reduced.

The elastic structure is configured such that the coupling portion couples the second end portions of the first columnar portions adjacent to each other, and that the second end portions are connected, together with the coupling portion, to the second sole portion. With this configuration, the second end portions of the first columnar portions adjacent to each other and the coupling portion are integrally connected to the second sole portion. Thus, a connection region (a surface area) of the elastic structure connected to second sole portion is relatively large in the sole structure according to the first aspect, as compared to a known configuration (a configuration disclosed in Japanese Unexamined Patent Application No. 2019-165937 above) in which no coupling portion is provided and upper end portions of all columnar portions are independently connected to a lower surface of the midsole. As a result, the connection strength of the connection region is improved against shear stress generated in the sole structure by the cutting maneuvers or the like. Thus, even if the shear stress is concentrated excessively in the connection region by the cutting maneuvers or the like, the state can be easily maintained in which the second end portions of the first columnar portions and the coupling portion are connected to the second sole portion. As a result, the elastic structure of the first sole portion is less likely to be detached from the second sole portion, and therefore, a stacking state of the first sole portion and the second sole portion can be stabilized.

Thus, the first aspect of the present disclosure enables smooth cutting maneuvers or the like and can stabilize the stacking state in the sole structure.

A second aspect of the present disclosure is an embodiment of the first aspect. In the second aspect, the first sole portion has at least one groove recessed in the first sole portion from a side opposite to a side facing the second sole portion to the side facing the second sole portion. The coupling portion is arranged at a position corresponding to a bottom side of the groove.

In the second aspect of the present disclosure, the coupling portion is arranged at the position corresponding to the bottom side of the groove. This configuration makes the thickness of the coupling portion relatively small, and the stiffness of the coupling portion is reduced. As a result, elastic deformation of the first columnar portion is less likely to be interfered by the coupling portion. Since the thickness of the coupling portion is relatively small, the connection structure can be reduced in weight.

A third aspect of the present disclosure is an embodiment of the first aspect. In the third aspect, the elastic structure is arranged at a portion of the sole structure configured to correspond to a forefoot of a foot of a wearer. At least one of the first columnar portions is positioned in a region of the sole structure configured to correspond to a vicinity of a ball of the foot of the wearer.

In general, in a process of the cutting maneuvers or the like (specifically, at the time of contact of the foot of the wearer on a floor surface of a stadium and/or kicking out), the ground contact pressure (load) of the foot on the floor surface tends to be caused mainly on the ball of the foot of the wearer. Thus, in the third aspect of the present disclosure, at least one of first columnar portions of the elastic structure is positioned in a region corresponding to the vicinity of the ball of the foot of the wearer in the sole structure. According to this configuration, even if the shear stress is concentrated at the portion of the sole structure configured to correspond to the vicinity of the ball of the foot of the wearer in the process of the cutting maneuvers or the like, it is less likely that the elastic structure is detached from second sole portion at the position corresponding to the vicinity of the ball of the foot of the wearer, owing to the second end portion of the at least one first columnar portion and the coupling portion. Thus, the stacking state of the first sole portion and the second sole portion can be stabilized.

A fourth aspect of the present disclosure is an embodiment of the third aspect. In the fourth aspect, the plurality of first columnar portions is arranged concentrically about a portion of the sole structure configured to correspond to the ball of the foot of the wearer.

In the fourth aspect of the present disclosure, the plurality of first columnar portions is arranged concentrically about the position corresponding to the ball of the foot of the wearer in the sole structure. Thus, when the wearer moves (kicks out) in an arbitrary direction in the cutting maneuvers or the like, at least one of the plurality of first columnar portions located at a position in the arbitrary direction from the position corresponding to the ball of the foot of the wearer is elastically deformed. This configuration can properly assist the movement when the wearer moves (kicks out) in the arbitrary direction.

A fifth aspect of the present disclosure is an embodiment of the fourth aspect. In the fifth aspect, the coupling portion includes a plurality of coupling portions, and the plurality of coupling portions is arranged concentrically about the portion of the sole structure configured to correspond to the ball of the foot of the wearer.

In the fifth aspect of the present disclosure, the plurality of coupling portions is arranged concentrically about the portion of the sole structure configured to correspond to the ball of the foot of the wearer. That is, the plurality of first columnar portions and the plurality of coupling portions arranged concentrically about the position corresponding to the ball of the foot of the wearer increase the connection region of the elastic structure and the second sole portion. As a result, the stacking state of the first sole portion and the second sole portion can be further stabilized.

A sixth aspect of the present disclosure is an embodiment of any one of the first to fifth aspects. In the sixth aspect, the elastic structure further includes a plurality of elastically deformable second columnar portions extending along the thickness direction and spaced apart from each other in a direction perpendicular to the thickness direction. Each of the plurality of second columnar portions has a first end portion formed integrally with the base plate and a second end portion connected to the second sole portion. Each of the plurality of second columnar portions is configured such that the second end portion is independently connected to the second sole portion.

In the sixth aspect of the present disclosure, the second columnar portion is not coupled to the coupling portion, and is more likely to be elastically deformable than the first columnar portion. Specifically, the second columnar portion is configured such that the force for assisting the cutting maneuvers or the like is greater than that of the first columnar portion. Thus, the plurality of first columnar portions and the plurality of coupling portions can stabilize the stacking state of the first sole portion and the second sole portion, and the plurality of second columnar portions enables smoother cutting maneuvers or the like.

A seventh aspect of the present disclosure is an embodiment of the first aspect. In the seventh aspect, the first sole portion is positioned on a side closer to a ground contact surface side of the sole structure with respect to the second sole portion.

In the seventh aspect of the present disclosure, the base plate forming the first sole portion is positioned on a side closer to the ground contact surface side of the sole structure. Thus, the impact at the time of contact of the foot of the wearer is easily transmitted to the elastic structure (specifically, the plurality of first columnar portions and the plurality of second columnar portions) through the base plate. As a result, the sole structure easily exhibits its cushioning properties, and the loads on the feet or knees of the wearer in the cutting maneuvers or the like are easily reduced.

An eighth aspect of the present disclosure is an embodiment of the seventh aspect. In the eighth aspect, the base plate has, at a peripheral edge portion thereof, an outer wall portion for closing a space between the base plate and the second sole portion from side of the sole structure.

In the eighth aspect of the present disclosure, the outer wall portion provided at the peripheral edge portion of the base plate can prevent the entrance of a foreign object into the space between the base plate of the first sole portion and the second sole portion from the outside of the sole structure.

A ninth aspect of the present disclosure is an embodiment of the first aspect. In the ninth aspect, each of the plurality of first columnar portions is elastically deformable in the direction perpendicular to the thickness direction while maintaining a state in which the second end portion is connected, together with the coupling portion, to the second sole portion.

As described in the first aspect of the present disclosure, the ninth aspect of the present disclosure enables smooth cutting maneuvers or the like and can stabilize the stacking state in the sole structure.

A tenth aspect of the present disclosure is directed to a shoe including the sole structure of any one of the first to ninth aspects.

In the tenth aspect of the present disclosure, shoes providing advantages similar to those of the first to ninth aspects can be obtained.

Advantages of the Invention

As can be seen from the foregoing description, the present disclosure enables smooth cutting maneuvers or the like and can stabilize the stacking state in the sole structure.

DETAILED DESCRIPTION

Hereinafter, an embodiment of the present disclosure will be described in detail with reference to the drawings. The following description of the embodiment is merely exemplary in nature, and is not intended to limit the scope, application, or use of the present disclosure.

Figure 1:
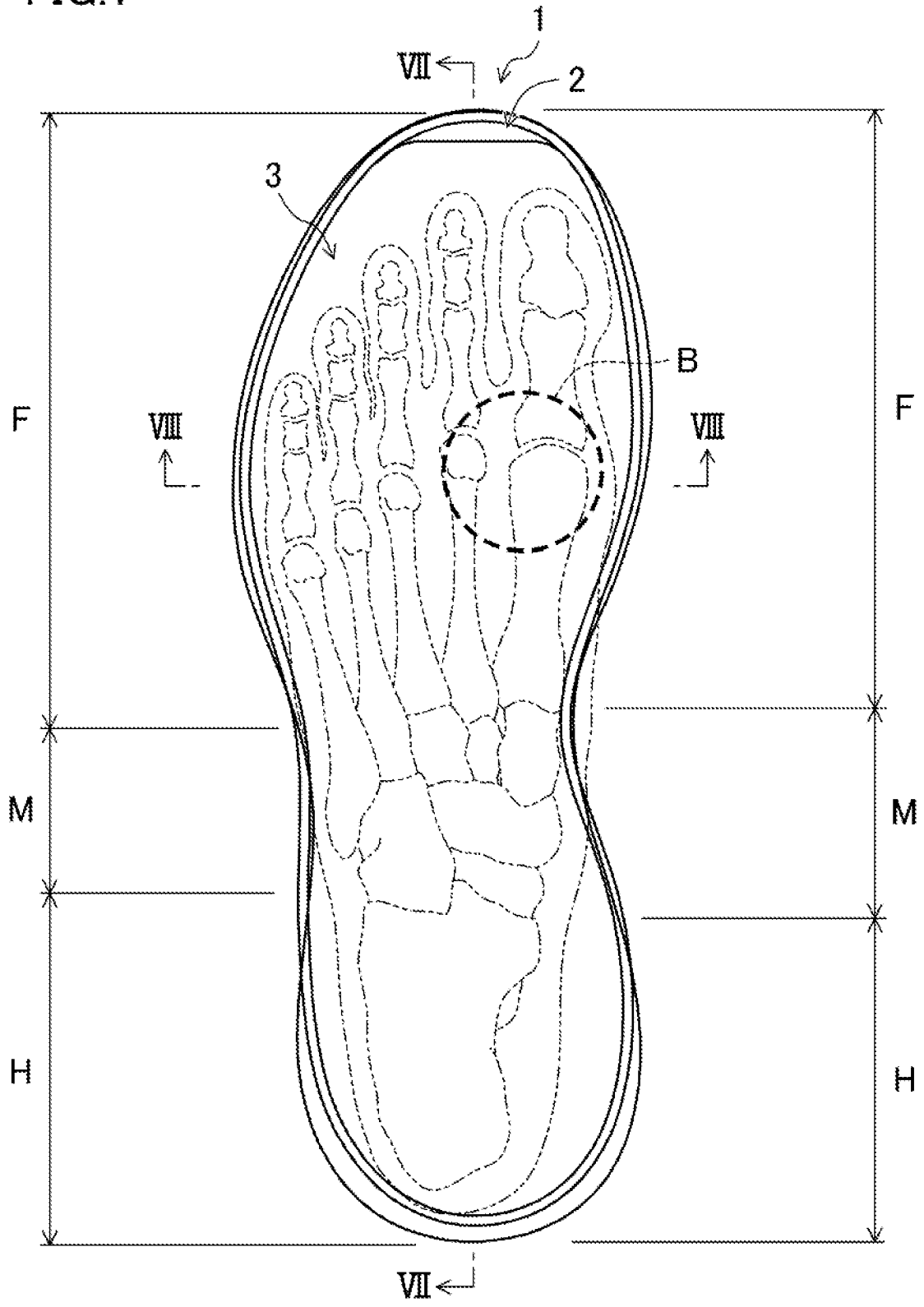
FIG. 1 is a top view virtually showing a state in which a skeletal structure of a foot of a wearer is layered on a sole structure according to an embodiment.
Figure 2:
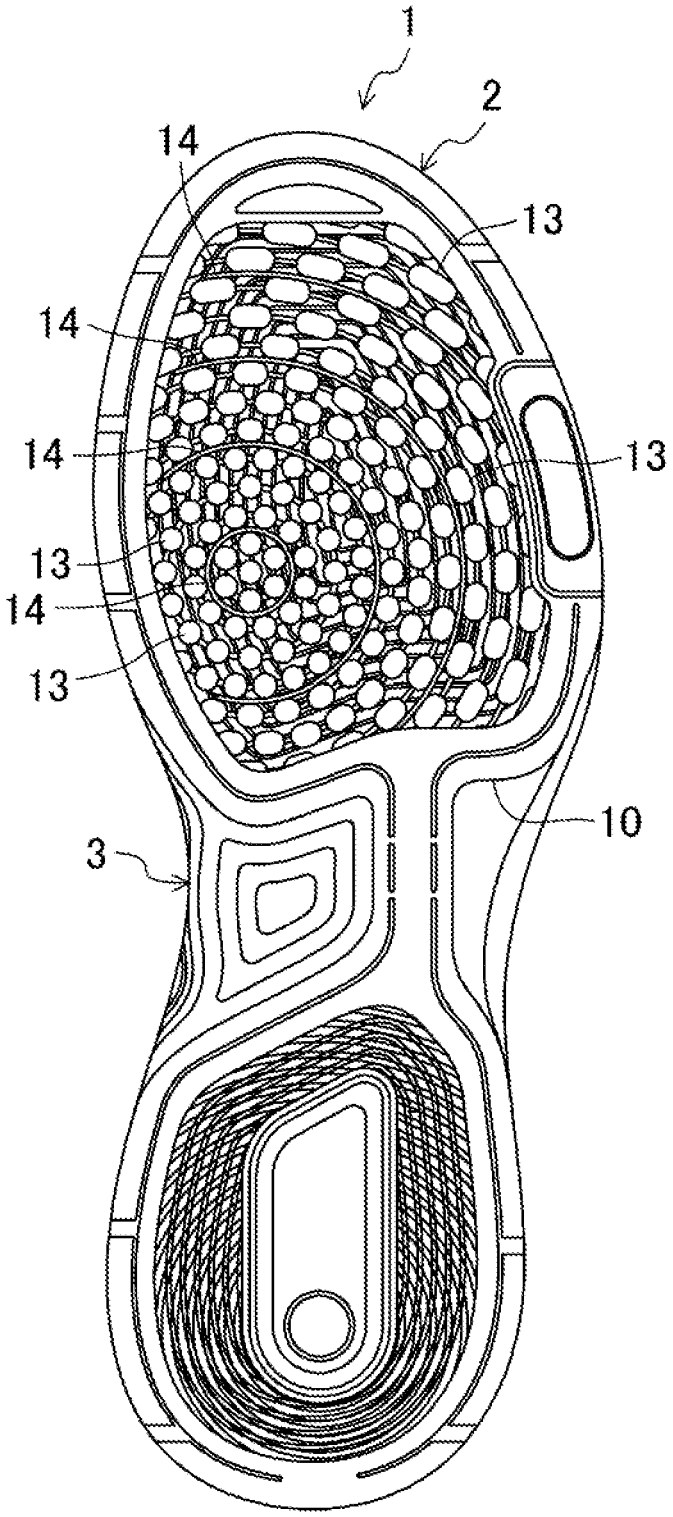
FIG. 2 is a bottom view of the sole structure.
Figure 3:
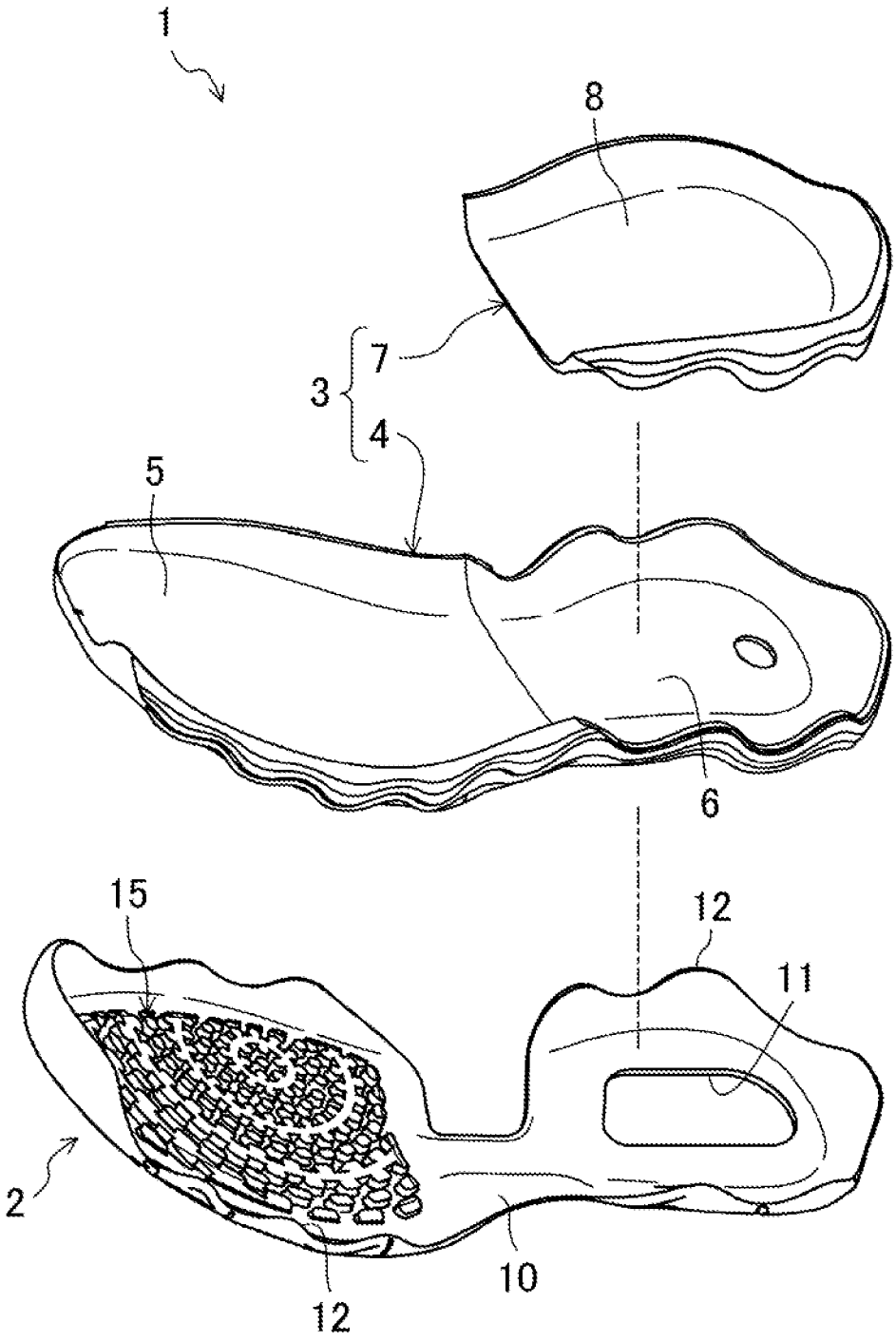
FIG. 3 is an exploded perspective view of each configuration of the sole structure.

FIGS. 1 to 3 show a sole structure 1 of an embodiment of the present disclosure. Shoes including the sole structure 1 are used as, e.g., sports shoes for running or various types of games.

The drawings show the sole structure 1 for a left shoe only. A sole structure for a right shoe is symmetrical to the sole structure for the left shoe. Thus, only the sole structure for the left shoe will be described in the following description, and the description of the sole structure for the right shoe will be omitted herein.

In the following description, a "front side" and a "rear side" represent a positional relationship in a foot length direction of the sole structure 1. Specifically, in the sole structure 1 shown in FIG. 1, the side of a position corresponding to a toe portion of a foot of a person (hereinafter, referred to as a "wearer") wearing the shoe including the sole structure 1 is the "front side," and the side of a position corresponding to a heel portion of the foot of the wearer is the "rear side."

Further, in the following description, an "inner side" indicates a medial side of the shoe including the sole structure 1, and an "outer side" indicates a lateral side of the shoe. Specifically, the side of a position corresponding to the first toe (the hallux) of the foot of the wearer with respect to the center of the foot when viewed in the foot length direction (the center in the foot width direction) is the "inner side," and the side of a position corresponding to the fifth toe (the little toe) of the foot of the wearer with respect to the center in the foot width direction is the "outer side."

Further, in the following description, an "upper side (upward, above)" and a "lower side (downward, below)" represent a positional relationship in an up-down direction corresponding to a thickness direction of the sole structure 1 (hereinafter, referred to as a "thickness direction"). Specifically, the "upper side (upward, above)" indicates the side where planta contact surfaces 5 and 8, described later, are positioned in the sole structure 1, as shown in FIG. 3. The "lower side (downward, below)" indicates the side where a ground contact surface of an outsole 2, described later, is positioned in the sole structure 1.

Further, in the sole structure 1 shown in FIG. 1, an area corresponding to a forefoot of the foot of the wearer is indicated by a reference sign F; an area corresponding to a midfoot of the foot of the wearer is indicated by a reference sign M; and an area corresponding to a hindfoot of the foot of the wearer is indicated by a reference sign H.

As shown in FIGS. 1 to 3, the sole structure 1 includes an outsole 2 and a midsole 3. In the sole structure 1 described as an example in the present embodiment, the outsole 2 corresponds to a "first sole portion" and the midsole 3 corresponds to a "second sole portion." For the sake of convenience in description, the configuration of the midsole 3 will be described below in advance of the configuration of the outsole 2.

(Midsole)

As shown in FIGS. 1 to 3, the midsole 3 is configured to support a planta surface of the wearer. The midsole 3 is stacked on the upper side of the outsole 2 in the thickness direction. The shoe including the sole structure 1 has an upper (not shown) provided at the midsole 3 for covering the foot of the wearer.

The midsole 3 is made of a soft elastic material which is less rigid than the outsole 2. Specifically, examples of the material suitable for the midsole 3 include thermoplastic synthetic resins such as an ethylene-vinyl acetate copolymer (EVA) and foams thereof, thermosetting resins such as polyurethane (PU) and foams thereof, and rubbers such as butadiene rubber and chloroprene rubber and foams thereof. The midsole 3 preferably has a hardness of, for example, 15 C to 65 C on the Asker C scale.

The midsole 3 is divided in the vertical direction. Specifically, the midsole 3 has a lower midsole portion 4 and an upper midsole portion 7.

The lower midsole portion 4 is arranged in an area in the sole structure 1 corresponding to an area from the forefoot F to the hindfoot H of the foot of the wearer. The lower midsole portion 4 is stacked on the upper side of the outsole 2. A lower surface of the lower midsole portion 4 faces an upper surface of the outsole 2 (an upper surface of a base plate 10 described later).

The lower midsole portion 4 has a planta contact surface 5 on its upper portion (see FIG. 3). The planta contact surface 5 is arranged at a position in the sole structure 1 corresponding to the entire area of the forefoot F and a front portion of the midfoot M of the foot of the wearer.

The lower midsole portion 4 has a support surface 6 for supporting the upper midsole portion 7 (see FIG. 3). The support surface 6 is lower in position than the planta contact surface 5 in the thickness direction. The support surface 6 is arranged at a position in the sole structure 1 corresponding to an area from a rear portion of the midfoot M to the hindfoot H of the foot of the wearer.

The upper midsole portion 7 is stacked on the upper side of the lower midsole portion 4. Specifically, the upper midsole portion 7 is stacked on the support surface 6 of the lower midsole portion 4. The lower surface of the upper midsole portion 7 is bonded to the support surface 6 of the lower midsole portion 4 with an adhesive or the like.

The upper midsole portion 7 has a planta contact surface 8 on its upper surface. The planta contact surface 8 is arranged at a position in the sole structure 1 corresponding to a rear portion of the midfoot M and the hindfoot H of the foot of the wearer. The planta contact surface 5 of the upper midsole portion 7 and the planta contact surface 8 of the lower midsole portion 4 are flush with each other (see FIG. 7).

(Outsole)

As shown in FIGS. 1 to 3, the outsole 2 is stacked on the lower side of the midsole 3 in the thickness direction. The outsole 2 is arranged in an area in the sole structure 1 corresponding to an area from the forefoot F to the hindfoot H of the foot of the wearer.

The outsole 2 is made of a hard elastic material having a greater hardness than that of the midsole 3. Specifically, examples of the material suitable for the outsole 2 include thermoplastic synthetic resins such as an ethylene-vinyl acetate copolymer (EVA), thermosetting resins such as polyurethane (PU), rubber materials such as butadiene rubber and chloroprene rubber, and foam materials obtained by foaming these materials. The hardness of the outsole 2 is preferably set, for example, to 50 A to 80 A (more preferably 60 A to 70 A) in a durometer C or A.

As shown in FIGS. 2 and 3, the outsole 2 has the base plate 10. The base plate 10 has substantially a plate-like shape. The base plate 10 is formed such that the width of a portion in the sole structure 1 corresponding to the midfoot M of the foot of the wearer is smaller in a foot width direction than the width of a portion corresponding to the forefoot F of the foot of the wearer. Further, the base plate 10 is formed such that the portion in the sole structure 1 corresponding to the midfoot M of the foot of the wearer is closer to the lateral side.

The base plate 10 has a hole 11. The hole 11 is arranged at a position of the base plate 10 corresponding to the hindfoot H of the foot of the wearer. The hole 11 is formed so as to penetrate the base plate 10 in the thickness direction.

Figure 7:
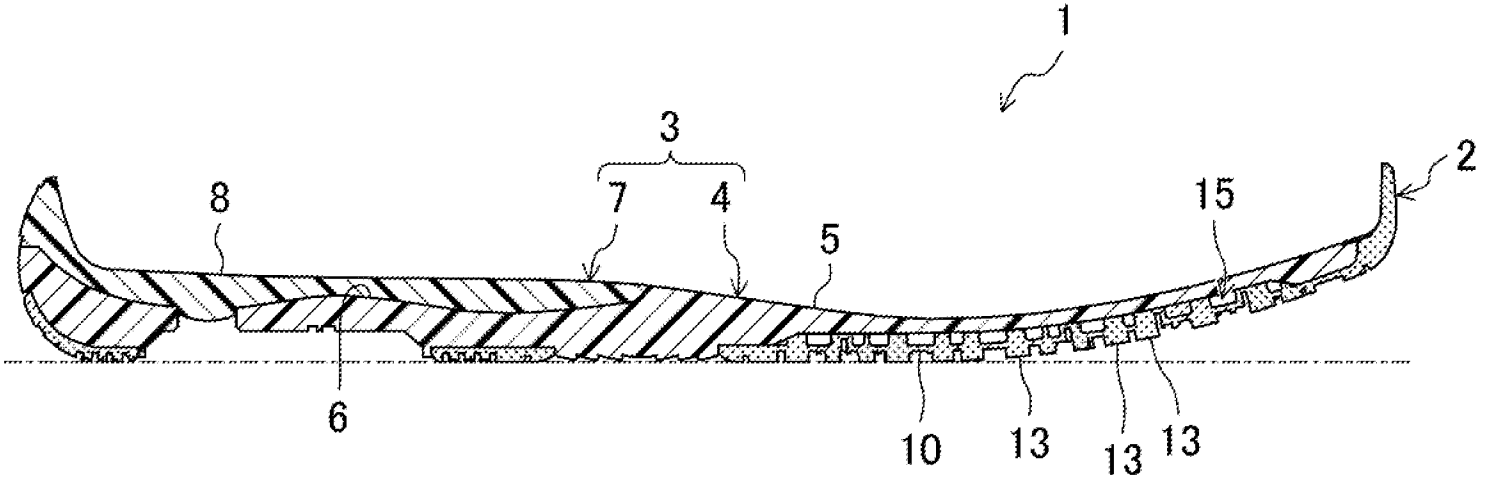
FIG. 7 is a cross-sectional view taken along line VII-VII shown in FIG. 1.
Figure 8:
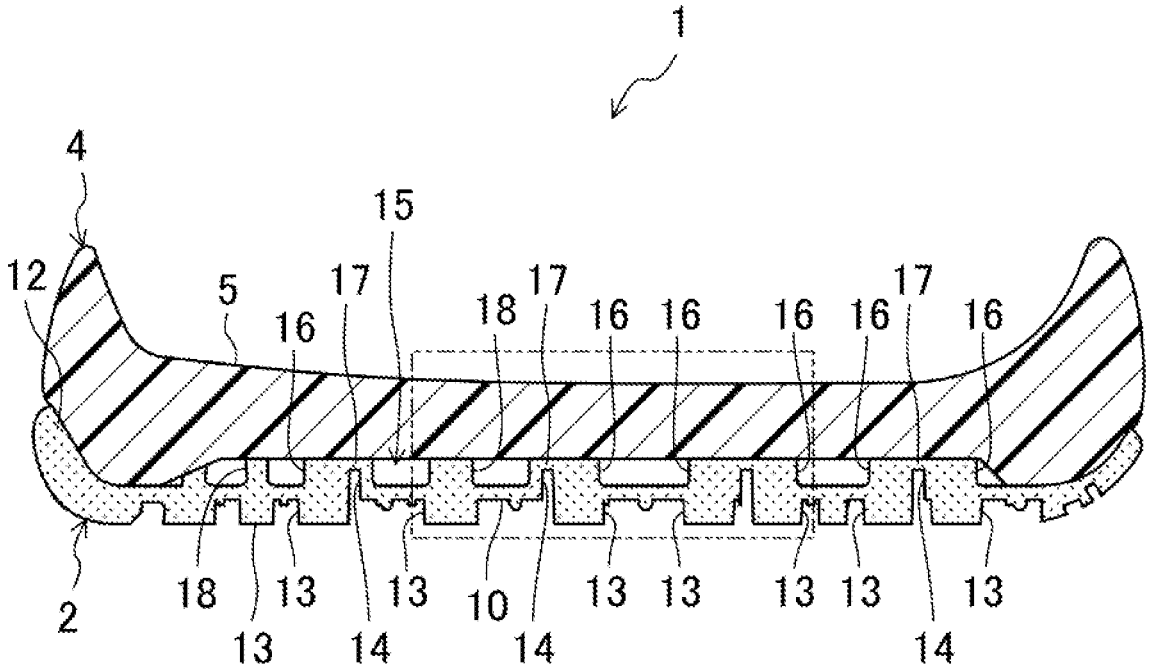
FIG. 8 is a cross-sectional view taken along line VIII-VIII shown in FIG. 1.
Figure 9:
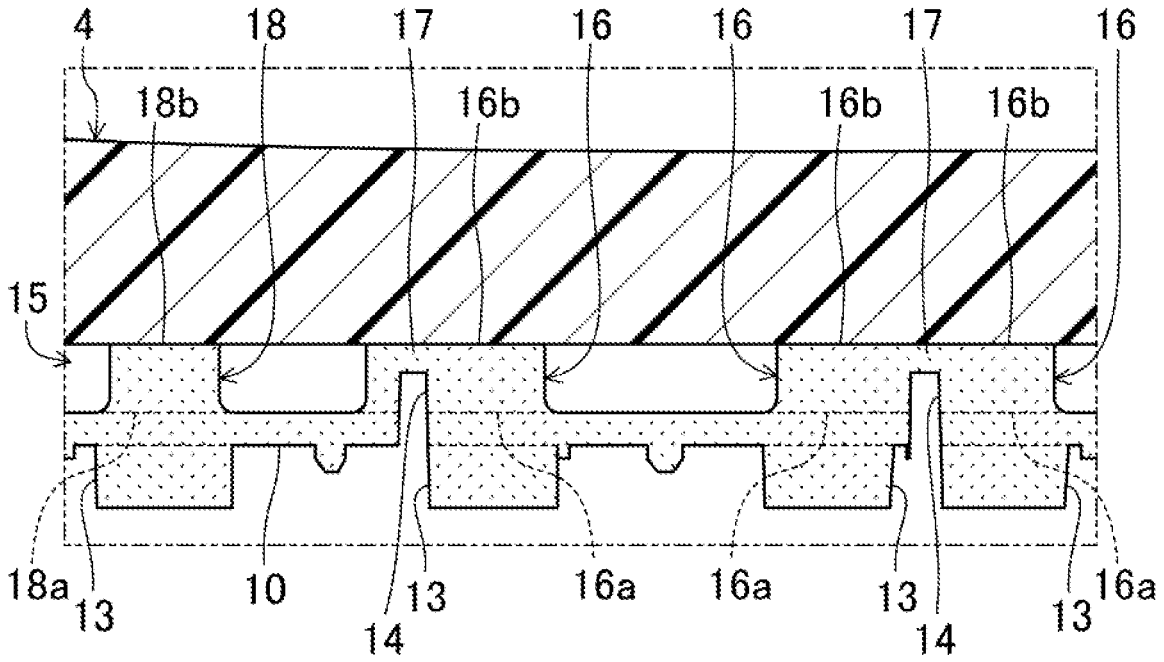
FIG. 9 is a partially enlarged view of the vertical cross-sectional view shown in FIG. 8.

As shown in FIGS. 7 to 9, the base plate 10 is configured such that an upper surface of the portion corresponding to the forefoot F of the foot of the wearer is apart from the lower surface of the lower midsole portion 4 in the thickness direction. On the other hand, as shown in FIG. 7, the base plate 10 is configured such that upper surfaces of the portions corresponding to the midfoot M and the hindfoot H of the foot of the wearer are in contact with the lower surface of the lower midsole portion 4.

Figure 4:
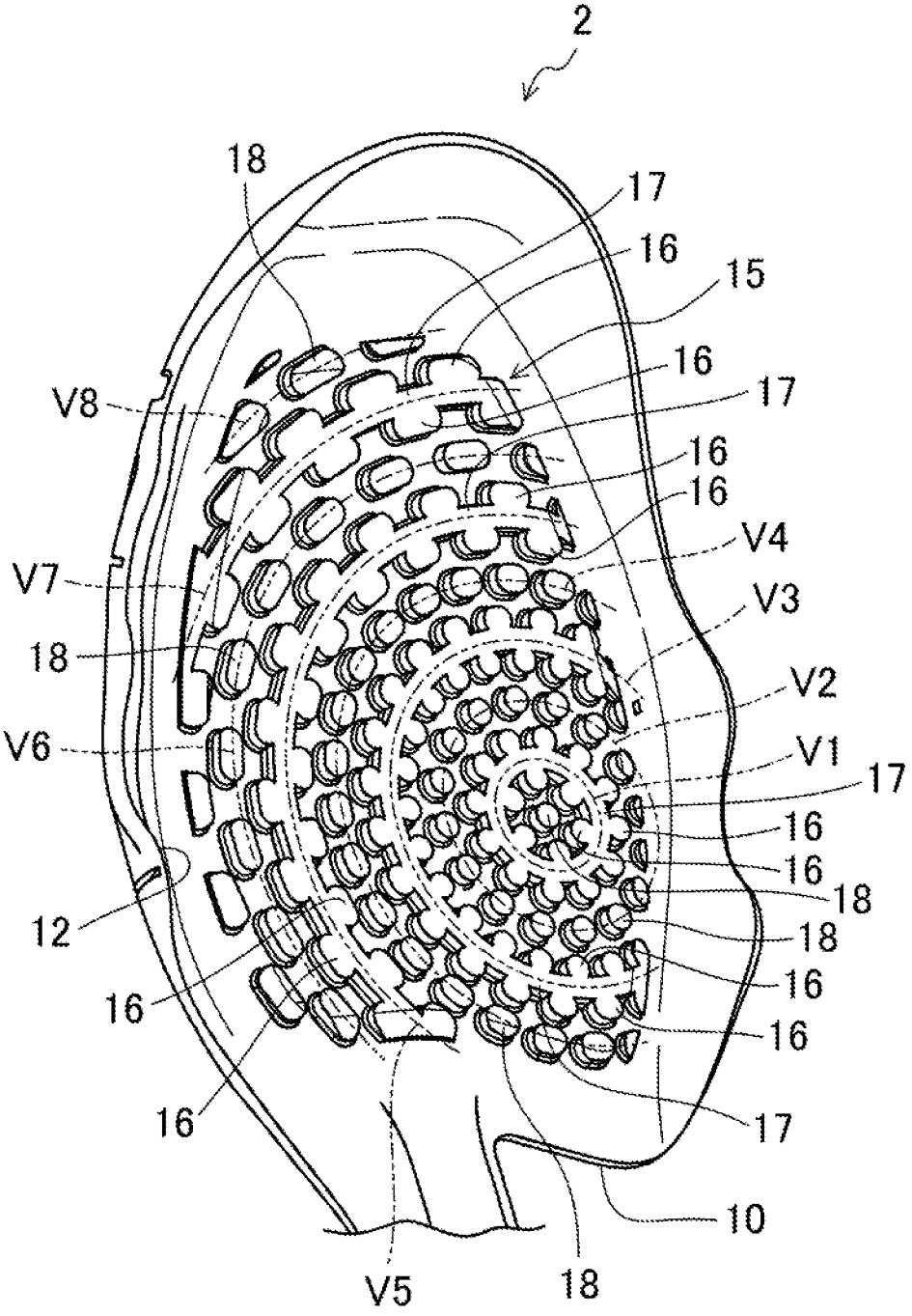
FIG. 4 is an enlarged view of a front portion of an outsole, viewed from above.

As shown in FIGS. 3 and 4, the base plate 10 has outer wall portions 12 and 12 at a peripheral edge portion. In particular, the outer wall portion 12 arranged at a position in the sole structure 1 corresponding to the forefoot F of the foot of the wearer closes a space between the base plate 10 and the lower midsole portion 4 from both the medial side and the lateral side (see FIG. 8). This configuration makes the space between the base plate 10 and the lower midsole portion 4 invisible from the outside.

The outer wall portions 12 and 12 are arranged at positions corresponding to the forefoot F and the hindfoot H of the foot of the wearer. The outer wall portions 12 and 12 are arranged at peripheral edge portions of the base plate 10 positioned on both the medial side and the lateral side. Each outer wall portion 12 stands upwardly from the peripheral edge portion of the base plate 10. When the sole structure 1 is viewed from the side (the medial side and the lateral side), each outer wall portion 12 has an upper end portion in substantially a wavelike shape waving up and down. Each outer wall portion 12 is fixed to a side surface of the lower midsole portion 4 with an adhesive or the like.

Figure 6:
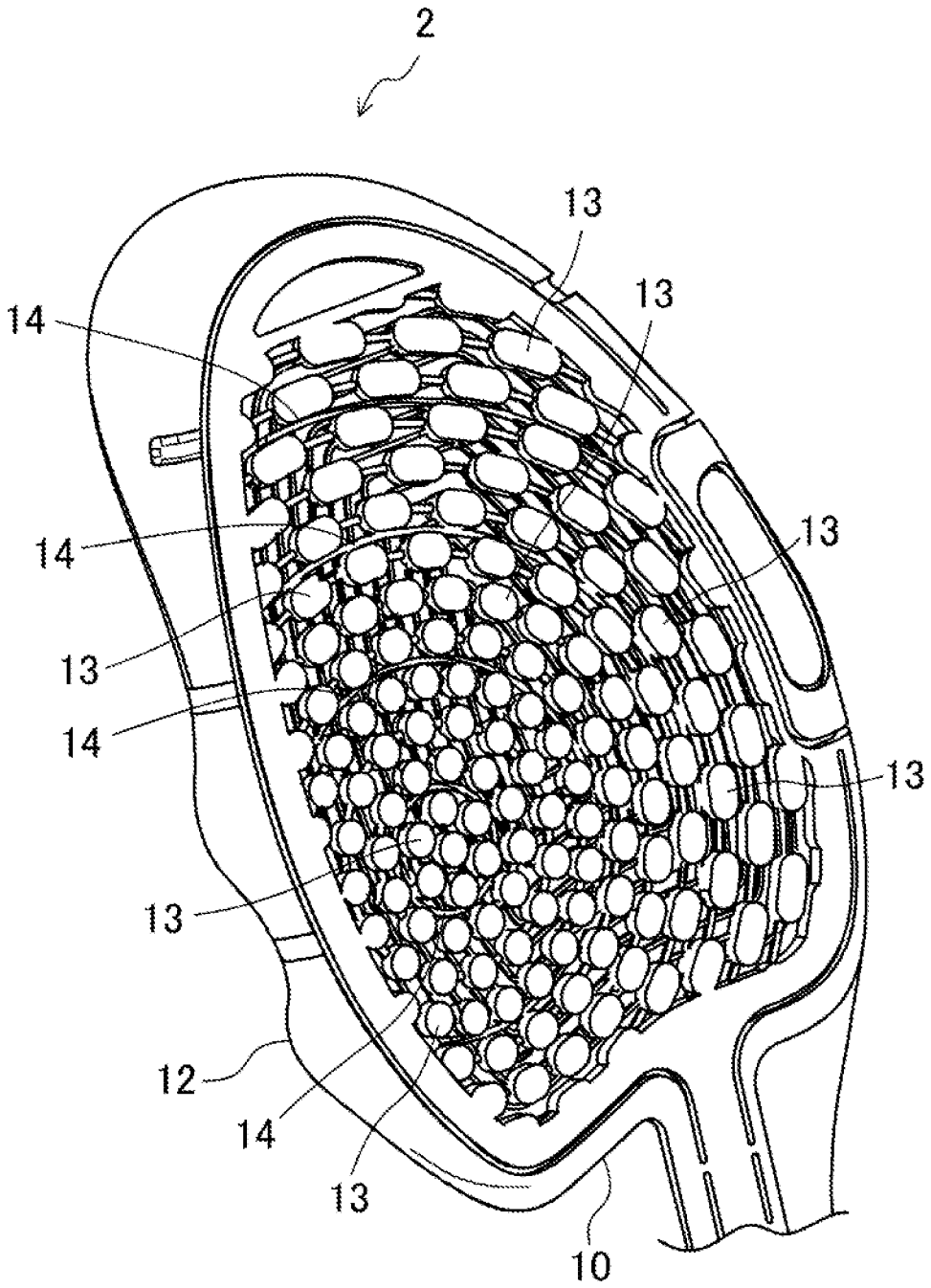
FIG. 6 is an enlarged view of the front portion of the outsole, viewed from below.

As shown in FIGS. 2 and 6, the base plate 10 has a plurality of studs 13 on the lower surface side. Each stud 13 has a substantially columnar shape or a substantially bale-like shape. The "bale-like shape" of each stud 13 refers to a columnar shape in which the bottom surface of each stud 13 has substantially an oval shape. The plurality of studs 13 described as an example in the present embodiment is arranged at a position in the sole structure 1 corresponding to the forefoot F of the foot of the wearer. The studs 13 are spaced apart from each other in a direction along the lower surface of the base plate 10.

As shown in FIGS. 7 to 9, the studs 13 protrude downward from the lower surface of the base plate 10. A lower surface of each stud 13 corresponds to the ground contact surface of the outsole 2 in the sole structure 1. In a vertical cross-sectional view, each stud 13 is arranged to overlap with an associated one of first columnar portions 16 or second columnar portions 18, described later, in the thickness direction.

(First to Eighth Virtual Lines)

Here, first to eighth virtual lines V1 to V8 shown in mainly FIGS. 4 and 5 will be described. The first to eighth virtual lines V1 to V8 are virtual reference lines for arranging a plurality of grooves 14, a plurality of first columnar portions 16, a plurality of coupling portions 17, and a plurality of second columnar portions 18 (all of them will be described later) at predetermined positions.

Figure 5:
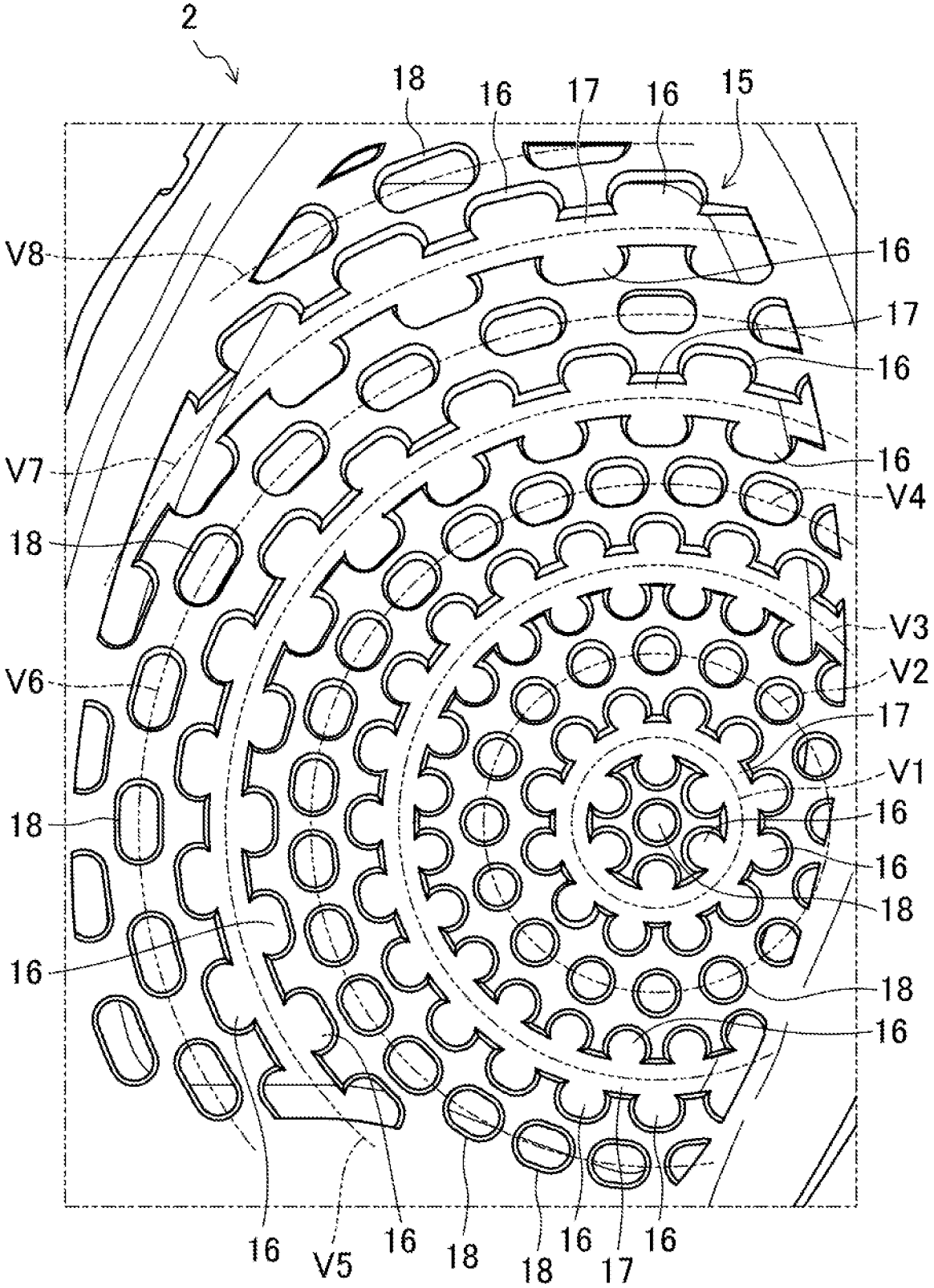
FIG. 5 is an enlarged view of an elastic structure.

As shown in FIGS. 4 and 5, the first virtual line V1 has a circular shape in plan view. Each of the second to eighth virtual lines V2 to V8 has an arc shape in plan view. The first virtual line V1 is arranged in a region in the sole structure 1 (a region B indicated by a thick dashed line in FIG. 1 as an example) corresponding to the vicinity of the ball of the foot of the wearer. The first to eighth virtual lines V1 to V8 are arranged concentrically about a position in the sole structure 1 corresponding to the ball of the foot of the wearer. The first to eighth virtual lines V1 to V8 are spaced apart from each other in a radially outward direction of a circle formed by the first virtual line V1.

The circle formed by the first virtual line V1 and the arcs formed by the second to eighth virtual lines V2 to V8 have different radii. Specifically, the radius of the circle formed by the first virtual line V1 is smaller than any of the radii of the arcs formed by the second to eighth virtual lines V2 to V8. The radii of the arcs of the second to eighth virtual lines V2 to V8 become greater in the order from the second virtual line V2 to the eighth virtual line V8.

(Groove)

As shown in FIGS. 2 and 6, the outsole 2 has a plurality of grooves 14 on the ground contact surface. Each groove 14 is recessed in the outsole 2 from the ground contact surface side of the studs 13 (i.e., the side opposite to the side facing the midsole 3) to the side facing the midsole 3.

Figure 11:
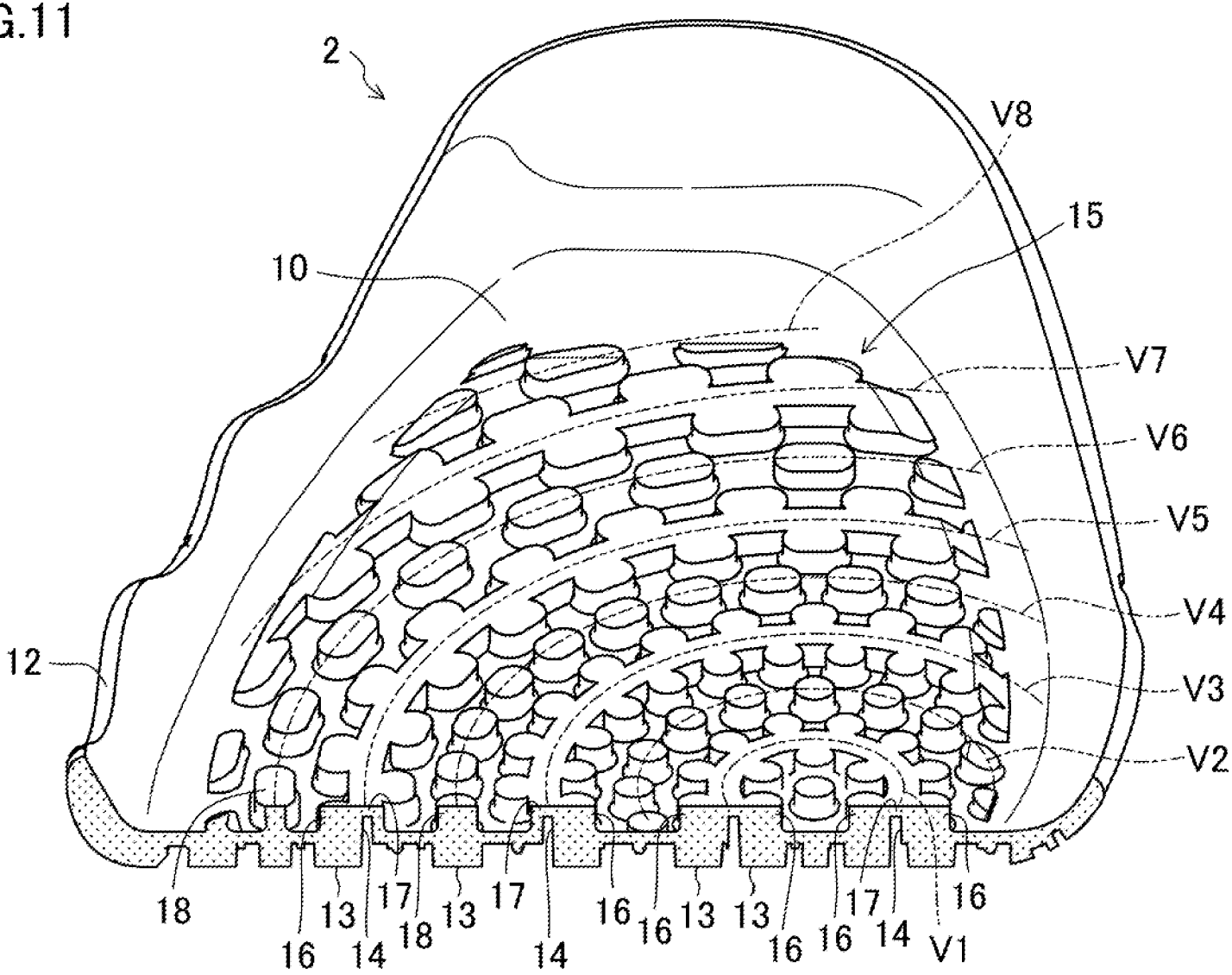
FIG. 11 is a view showing the state of the vertical cross-sectional view of FIG. 8 from the upper back side of the outsole.
Figure 12:
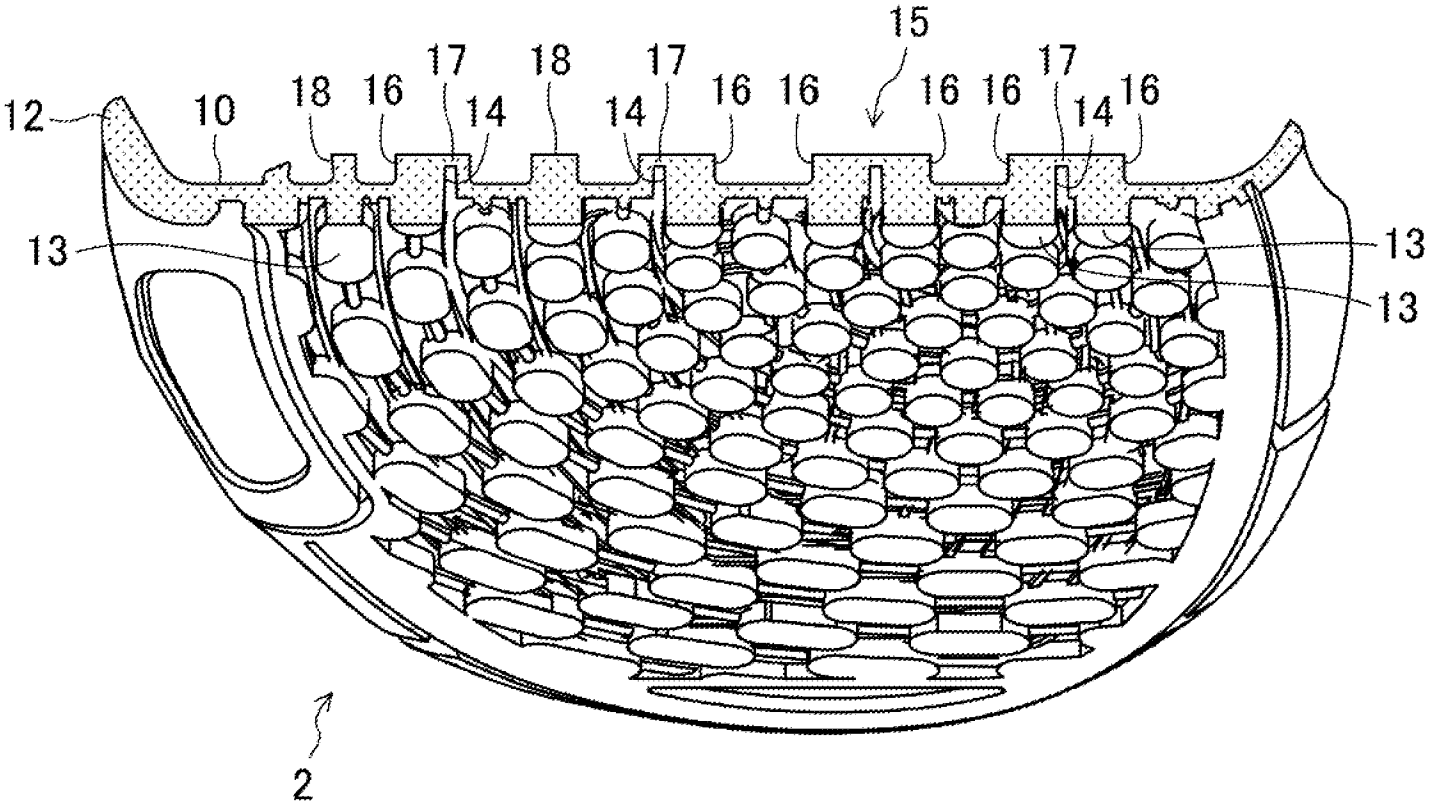
FIG. 12 is a view showing the state of the vertical cross-sectional view of FIG. 8 from the lower back side of the outsole.

Each groove 14 is arranged on a corresponding one of the first, third, fifth, and seventh virtual lines V1, V3, V5, V7 (see FIG. 11). The grooves 14 are arranged concentrically about the position in the sole structure 1 corresponding to the ball of the foot of the wearer. The groove 14 positioned on the first virtual line V1 is arranged in a region in the sole structure 1 corresponding to the vicinity of the ball of the foot of the wearer. The groove 14 positioned on the first virtual line V1 has an annular shape extending along the direction of extension of the first virtual line V1. Each of the grooves 14 positioned on the third, fifth, and seventh virtual lines V3, V5, V7 has an arc shape extending along the direction of extension of the virtual line.

(Elastic Structure)

As shown in FIGS. 3 to 5, the outsole 2 has an elastic structure 15. The elastic structure 15 is arranged between the lower midsole portion 4 and the base plate 10 in the thickness direction (see FIGS. 7 and 8). The elastic structure 15 is configured to maintain a state in which the upper surface of the base plate 10 and the lower surface of the lower midsole portion 4 are apart from each other in the thickness direction.

The elastic structure 15 is formed integrally with the base plate 10. The elastic structure 15 is arranged at a position of the base plate 10 corresponding mainly to the forefoot F of the foot of the wearer.

The elastic structure 15 includes the plurality of first columnar portions 16, the plurality of coupling portions 17, and the plurality of second columnar portions 18.

(First Columnar Portion)

The plurality of first columnar portions 16 is made of the same material as that of the outsole 2. The plurality of first columnar portions 16 is elastically deformable in a direction perpendicular to the thickness direction (in a direction along the upper surface of the base plate 10) (see FIG. 10).

As shown in FIGS. 8 and 9, each of the first columnar portions 16 is formed integrally with the base plate 10. Each of the first columnar portions 16 extends upward in a columnar shape from the upper surface of the base plate 10.

Each of the first columnar portions 16 has a first end portion 16*a* and a second end portion 16*b*. The first end portion 16*a* corresponds to a lower end portion of the first columnar portion 16. The first end portion 16*a* is positioned on the upper surface side of the base plate 10, and is continuous with the upper surface of the base plate 10.

The second end portion 16*b* corresponds to an upper end portion of the first columnar portion 16. The second end portion 16*b* is positioned on the lower surface side of the lower midsole portion 4. The second end portion 16*b* is flush with an upper surface of each of the coupling portions 17. The second end portion 16*b* of each first columnar portion 16 is connected to the midsole 3, together with the coupling portion 17. Specifically, the second end portion 16*b* of each first columnar portion 16 and the upper surface of each coupling portion 17 are fixed to the lower surface of the lower midsole portion 4 with an adhesive, for example.

As shown in FIGS. 4 and 5, the first columnar portions 16 are spaced apart from each other in a direction perpendicular to the thickness direction (in a direction along the upper surface of the base plate 10). The first columnar portions 16 are arranged concentrically about the position in the sole structure 1 corresponding to the ball of the foot of the wearer.

The first columnar portions 16 having a substantially columnar shape are arranged in the vicinity of the first virtual line V1. The first columnar portions 16 positioned in the vicinity of the first virtual line V1 are arranged in the region in the sole structure 1 (see the region B shown in FIG. 1 as an example) corresponding to the vicinity of the ball of the foot of the wearer. In the vicinity of the inside of the circle formed by the first virtual line V1, six first columnar portions 16 are arranged at equal intervals along the direction of extension of the first virtual line V1 in the shown example. In the vicinity of the outside of the circle formed by the first virtual line V1, twelve first columnar portions 16 are arranged at equal intervals along the direction of extension of the first virtual line V1 in the shown example. Each of the first columnar portions 16 positioned in the vicinity of the inside of the circle formed by the first virtual line V1 and each of the first columnar portions 16 positioned in the vicinity of the outside of the same circle are alternately arranged along the direction of extension of the first virtual line V1.

The plurality of first columnar portions 16 having a substantially columnar shape is arranged in the vicinity of the inside of the arc formed by the third virtual line V3. On the other hand, in the vicinity of the outside of the arc formed by the third virtual line V3, the plurality of first columnar portions 16 having a substantially bale-like shape in plan view is arranged. The "bale-like shape" of each first columnar portion 16 refers to a columnar shape in which the top surface of each first columnar portion 16 has substantially an oval shape. Each of the first columnar portions 16 positioned in the vicinity of the outside of the arc formed by the third virtual line V3 is arranged such that the longitudinal direction of the bale-like shape in plan view is along the direction of extension of the third virtual line V3.

In the vicinity of the inside of the arc formed by the third virtual line V3, eighteen first columnar portions 16 are arranged at equal intervals along the direction of extension of the third virtual line V3 in the shown example. In the vicinity of the outside of the arc formed by the third virtual line V3, sixteen first columnar portions 16 are arranged at equal intervals along the direction of extension of the third virtual line V3 in the shown example. Each of the first columnar portions 16 positioned in the vicinity of the inside of the arc formed by the third virtual line V3 and each of the first columnar portions 16 positioned in the vicinity of the outside of the same arc are alternately arranged along the direction of extension of the third virtual line V3.

In the vicinity of the fifth virtual line V5, the plurality of first columnar portions 16 having a substantially bale-like shape in plan view is arranged. Each of the first columnar portions 16 positioned in the vicinity of the fifth virtual line V5 is arranged such that the longitudinal direction of the bale-like shape in plan view is along the direction of extension of the fifth virtual line V5.

In the vicinity of the inside of the arc formed by the fifth virtual line V5, eleven first columnar portions 16 are arranged at equal intervals along the direction of extension of the fifth virtual line V5 in the shown example. In the vicinity of the outside of the arc formed by the fifth virtual line V5, ten first columnar portions 16 are arranged at equal intervals along the direction of extension of the fifth virtual line V5 in the shown example. Each of the first columnar portions 16 positioned in the vicinity of the inside of the arc formed by the fifth virtual line V5 and each of the first columnar portions 16 positioned in the vicinity of the outside of the same arc are alternately arranged along the direction of extension of the fifth virtual line V5.

In the vicinity of the seventh virtual line V7, the plurality of first columnar portions 16 having a substantially bale-like shape in plan view is arranged. Each of the first columnar portions 16 positioned in the vicinity of the seventh virtual line V7 is arranged such that the longitudinal direction of the bale-like shape in plan view is along the direction of extension of the seventh virtual line V7.

In the vicinity of the inside of the arc formed by the seventh virtual line V7, six first columnar portions 16 are arranged at equal intervals along the direction of extension of the seventh virtual line V7 in the shown example. In the vicinity of the outside of the arc formed by the seventh virtual line V7, four first columnar portions 16 are arranged at equal intervals along the direction of extension of the seventh virtual line V7 in the shown example. Each of the first columnar portions 16 positioned in the vicinity of the inside of the arc formed by the seventh virtual line V7 and each of the first columnar portions 16 positioned in the vicinity of the outside of the same arc are alternately arranged along the direction of extension of the seventh virtual line V7.

(Coupling Portion)

As shown in FIGS. 4 and 5, each of the plurality (four in the shown example) of coupling portions 17 is arranged on a corresponding one of the first, third, fifth, and seventh virtual lines V1, V3, V5, V7. The plurality of coupling portions 17 is arranged concentrically about the position in the sole structure 1 corresponding to the ball of the foot of the wearer. The coupling portions 17 are spaced apart from each other in the radially outward direction of the circle formed by the first virtual line V1.

Each of the coupling portions 17 is continuous with the plurality of first columnar portions 16 positioned in the vicinity of the respective virtual lines. Each of the coupling portions 17 couples the second end portions 16*b*, 16*b* of the first columnar portions 16, 16 adjacent to each other in the vicinity of the respective virtual lines.

The coupling portion 17 positioned on the first virtual line V1 is arranged in a region in the sole structure 1 corresponding to the vicinity of the ball of the foot of the wearer. The coupling portion 17 positioned on the first virtual line V1 has an annular shape extending along the direction of extension of the first virtual line V1. The coupling portions 17 positioned on the third, fifth, and seventh virtual lines V3, V5, V7 have an arc shape extending along the direction of extension of the respective virtual lines.

As shown in FIGS. 8 to 12, each of the coupling portions 17 is arranged at a position corresponding to the bottom side of the respective groove 14, which is the side where the midsole 3 (the second sole portion) is provided as viewed from the outsole 2 (the first sole portion). That is, the coupling portions 17 are arranged at positions overlapping with the respective grooves 14 in the thickness direction. Specifically, each of the coupling portions 17 is configured to have a thickness as viewed in a vertical cross-section smaller than the height of the first columnar portions 16 (a length from the first end portion 16*a* to the second end portion 16*b* as shown in FIG. 9). That is, the coupling portions 17 have a relatively small thickness.

Each of the coupling portions 17 is arranged at a position corresponding to the groove 14 in the thickness direction. Specifically, as shown in FIG. 11, the coupling portion 17 positioned on the first virtual line V1 is arranged to correspond to the groove 14 positioned on the first virtual line V1. The coupling portion 17 positioned on the third virtual line V3 is arranged to correspond to the groove 14 positioned on the third virtual line V3. The coupling portion 17 positioned on the fifth virtual line V5 is arranged to correspond to the groove 14 positioned on the fifth virtual line V5. Although not shown, the coupling portion 17 positioned on the seventh virtual line V7 is arranged to correspond to the groove 14 positioned on the seventh virtual line V7.

(Second Columnar Portion)

The plurality of second columnar portions 18 is made of the same material as that of the outsole 2. The plurality of second columnar portions 18 is elastically deformable in a direction perpendicular to the thickness direction (in a direction along the upper surface of the base plate 10) (see FIG. 10).

As shown in FIGS. 8 and 9, each of the second columnar portions 18 is formed integrally with the base plate 10. Each of the second columnar portions 18 extends upward in a columnar shape from the upper surface of the base plate 10.

Each of the second columnar portions 18 has a first end portion 18*a* and a second end portion 18*b*. The first end portion 18*a* corresponds to a lower end portion of the second columnar portion 18. The first end portion 18*a* is positioned on the upper surface side of the base plate 10, and is continuous with the upper surface of the base plate 10.

The second end portion 18*b* of each of the second columnar portions 18 corresponds to an upper end portion of the second columnar portion 18. The second end portion 18*b* is positioned on the lower surface side of the lower midsole portion 4.

Each of the second columnar portions 18 is configured such that the second end portion 18*b* is independently connected to the lower midsole portion 4. That is, the second columnar portions 18 are not coupled to the coupling portion 17, unlike the first columnar portions 16. The second end portion 18*b* of each second columnar portion 18 is fixed to the lower surface of the lower midsole portion 4 with an adhesive, for example.

As shown in FIGS. 4 and 5, the second columnar portions 18 are spaced apart from each other in a direction perpendicular to the thickness direction (in a direction along the upper surface of the base plate 10). The plurality of second columnar portions 18 is arranged concentrically about the position in the sole structure 1 corresponding to the ball of the foot of the wearer.

One second columnar portion 18 having a columnar shape is arranged at the center of the circle formed by the first virtual line V1. Specifically, the second columnar portion 18 is arranged at the position in the sole structure 1 corresponding to the ball of the foot of the wearer in plan view.

The plurality (sixteen in the shown example) of second columnar portions 18 having a columnar shape is arranged on the second virtual line V2. The second columnar portions 18 positioned on the second virtual line V2 are arranged at equal intervals along the direction of extension of the second virtual line V2. The second columnar portions 18 positioned on the second virtual line V2 are arranged to form an annular shape that is concentric, in plan view, with the circle formed by the first virtual line V1.

The plurality (eighteen in the shown example) of second columnar portions 18 having a substantially bale-like shape in plan view is arranged on the fourth virtual line V4. Each of the second columnar portions 18 positioned on the fourth virtual line V4 is arranged such that the longitudinal direction of the bale-like shape in plan view is along the fourth virtual line V4. The second columnar portions 18 positioned on the fourth virtual line V4 are arranged at equal intervals along the direction of extension of the fourth virtual line V4. The second columnar portions 18 positioned on the fourth virtual line V4 are arranged to form an arc shape that is concentric, in plan view, with the circle formed by the first virtual line V1.

The plurality (ten in the shown example) of second columnar portions 18 having a substantially bale-like shape in plan view is arranged on the sixth virtual line V6. Each of the second columnar portions 18 positioned on the sixth virtual line V6 is arranged such that the longitudinal direction of the bale-like shape in plan view is along the sixth virtual line V6. The second columnar portions 18 positioned on the sixth virtual line V6 are arranged at equal intervals along the direction of extension of the sixth virtual line V6. The second columnar portions 18 positioned on the sixth virtual line V6 are arranged to form an arc shape that is concentric, in plan view, with the circle formed by the first virtual line V1.

The plurality (three in the shown example) of second columnar portions 18 having a substantially bale-like shape in plan view is arranged on the eighth virtual line V8. Each of the second columnar portions 18 positioned on the eighth virtual line V8 is arranged such that the longitudinal direction of the bale-like shape in plan view is along the eighth virtual line V8. The second columnar portions 18 positioned on the eighth virtual line V8 are arranged at equal intervals along the direction of extension of the eighth virtual line V8. The second columnar portions 18 positioned on the eighth virtual line V8 are arranged to form an arc shape that is concentric, in plan view, with the circle formed by the first virtual line V1.

(Characteristic Configuration)

As a characteristic configuration of the present embodiment, the elastic structure 15 is configured such that the coupling portion 17 couples the second end portions 16*b*, 16*b* of the first columnar portions 16, 16 adjacent to each other, and that the second end portions 16*b*, 16*b* are connected, together with the coupling portion 17, to the lower surface of the lower midsole portion 4. Further, each of the first columnar portions 16 is configured to be elastically deformable in the direction perpendicular to the thickness direction while maintaining the state in which the second end portion 16*b* is connected, together with the coupling portion 17, to the lower surface of the lower midsole portion 4. The midsole 3 is configured such that a portion of the lower midsole portion 4 corresponding to the forefoot F of the foot of the wearer is movable in the direction perpendicular to the thickness direction according to elastic deformation of each of the first columnar portions 16 (e.g., in the direction of arrow shown in FIG. 10).

Advantages of Embodiment

In games of indoor sporting events such as badminton and table tennis, players frequently perform quick movements, such as "side step" shifting in right or left direction or "cutting maneuvers" shifting in any direction not limited to right and left directions (hereinafter will be referred to as "cutting maneuvers or the like"). With regard to these cutting maneuvers or the like, there has been a demand that sole structures of the shoes applied to games of the above-described indoor sporting events assist the cutting maneuvers or the like and reduce loads on the feet or knees of a wearer (player). In response to such a demand, the outsole 2 of the sole structure 1 according to the present embodiment has the elastic structure 15 including the plurality of first columnar portions 16. The plurality of first columnar portions 16 is elastically deformable in the direction perpendicular to the thickness direction of the sole structure 1. Thus, each of the first columnar portions 16 are elastically deformed in the predetermined direction (e.g., the direction of the arrow shown in FIG. 10) when an external force is applied to the sole structure 1 by the cutting maneuvers or the like. Internal stress generated at each of the first columnar portions 16 by such elastic deformation is transformed into a restoring force restoring the first columnar portion 16 to its original state. This restoring force can increase a kick force of the wearer (player) when the wearer is about to move in an arbitrary direction (e.g., a direction opposite to the direction indicated by arrow in FIG. 10) in the cutting maneuvers or the like. That is, the restoring force functions as a force for assisting the cutting maneuvers or the like by the wearer. Accordingly, the wearer can smoothly perform the cutting maneuvers or the like. Further, the elastic deformation of the first columnar portions 16 increases the cushioning properties of the sole structure 1. Thus, loads on the feet or knees of the wearer in the cutting maneuvers or the like are reduced.

The elastic structure 15 is configured such that the coupling portion 17 couples the second end portions 16*b*, 16*b* of the first columnar portions 16, 16 adjacent to each other, and that the second end portions 16*b*, 16*b* are connected, together with the coupling portion 17, to the lower surface of the lower midsole portion 4. With this configuration, the second end portions 16*b*, 16*b* of the first columnar portions 16, 16 adjacent to each other and the coupling portion 17 are integrally connected to the lower surface of the lower midsole portion 4. Thus, a connection region (a surface area) of the elastic structure 15 connected to the lower surface of the lower midsole portion 4 is relatively large in the sole structure 1 according to the present embodiment, as compared to a known configuration (a configuration disclosed in Japanese Unexamined Patent Application No. 2019-165937 above) in which no coupling portion 17 is provided and end portions of all columnar portions are independently connected to a lower surface of the midsole. As a result, in the sole structure 1, the connection strength of the connection region is improved against shear stress generated in the sole structure 1 by the cutting maneuvers or the like. Thus, even if the shear stress is concentrated excessively in the connection region by the cutting maneuvers or the like, the state can be easily maintained in which the second end portions 16*b*, 16*b* of the first columnar portions 16, 16 and the coupling portion 17 are connected to the lower surface of the lower midsole portion 4. As a result, the elastic structure 15 of the outsole 2 is less likely to be detached from the midsole 3, and therefore, a stacking state of the outsole 2 and the midsole 3 can be stabilized.

Thus, the sole structure 1 according to the present embodiment enables smooth cutting maneuvers or the like and can stabilize the stacking state in the sole structure 1.

The coupling portion 17 is arranged at the position corresponding to the bottom side of the groove 14. This configuration makes the thickness of the coupling portion 17 relatively small, and the stiffness of the coupling portion 17 is reduced. As a result, elastic deformation of the first columnar portion 16 is less likely to be interfered by the coupling portion 17. Since the thickness of the coupling portion 17 is relatively small, the connection structure can be reduced in weight.

In general, in a process of the cutting maneuvers or the like (specifically, at the time of contact of the foot of the wearer on a floor surface of a stadium and/or kicking out), the ground contact pressure (load) of the foot on the floor surface tends to be caused mainly on the ball of the foot of the wearer. For this reason, the elastic structure 15 is configured such that the plurality of first columnar portions 16 is positioned in the region in the sole structure 1 corresponding to the vicinity of the ball of the foot of the wearer. According to this configuration, even if the shear stress is concentrated at the position in the sole structure 1 corresponding to the vicinity of the ball of the foot of the wearer in the process of the cutting maneuvers or the like, it is less likely that the elastic structure 15 is detached from the midsole 3 at the position corresponding to the vicinity of the ball of the foot of the wearer, owing to the plurality of first columnar portions 16 and the coupling portion 17. Thus, the stacking state of the outsole 2 and the midsole 3 can be stabilized.

The plurality of first columnar portions 16 is arranged concentrically about the position in the sole structure 1 corresponding to the ball of the foot of the wearer. Thus, when the wearer moves (kicks out) in an arbitrary direction in the cutting maneuvers or the like, at least one of the plurality of first columnar portions 16 located at a position in the arbitrary direction from the position corresponding to the ball of the foot of the wearer is elastically deformed. This configuration can properly assist the movement when the wearer moves (kicks out) in the arbitrary direction.

The plurality of coupling portions 17 is arranged concentrically about the position in the sole structure 1 corresponding to the ball of the foot of the wearer. That is, the plurality of first columnar portions 16 and the plurality of coupling portions 17 arranged concentrically about the position corresponding to the ball of the foot of the wearer increase the connection region of the elastic structure 15 and the lower midsole portion 4. As a result, the stacking state of the outsole 2 and the midsole 3 can be further stabilized.

The elastic structure 15 further includes the plurality of elastically deformable second columnar portions 18. Each of the second columnar portions 18 is configured such that the second end portion 18*b* is independently connected to the lower surface of the lower midsole portion 4. That is, the second columnar portion 18 is not coupled to the coupling portion 17, and is more likely to be elastically deformable than the first columnar portions 16. Specifically, the second columnar portion 18 is configured such that the force for assisting the cutting maneuvers or the like is greater than that of the first columnar portion 16. Thus, in the sole structure 1 according to the present embodiment, the plurality of first columnar portions 16 and the plurality of coupling portions 17 can stabilize the stacking state of the outsole 2 and the midsole 3, and the plurality of second columnar portions 18 enables smoother cutting maneuvers or the like.

The outsole 2 (the first sole portion) is positioned on a side closer to a ground contact surface of the sole structure 1 with respect to the midsole 3 (the second sole portion). That is, the base plate 10 forming the outsole 2 is positioned on the side closer to the ground contact surface of the sole structure 1. Thus, the impact at the time of contact of the foot of the wearer is easily transmitted to the elastic structure 15 (specifically, the plurality of first columnar portions 16 and the plurality of second columnar portions 18) through the base plate 10. As a result, the sole structure 1 easily exhibits its cushioning properties, and the loads on the feet or knees of the wearer in the cutting maneuvers or the like are easily reduced.

The base plate 10 has, at a peripheral edge portion thereof, the outer wall portions 12 for closing the space between the base plate 10 and the lower midsole portion 4 from side of the sole structure 1. The outer wall portions 12 can prevent the entrance of a foreign object into the space between the base plate 10 and the lower midsole portion 4 from the outside of the sole structure 1.

Figure 10:
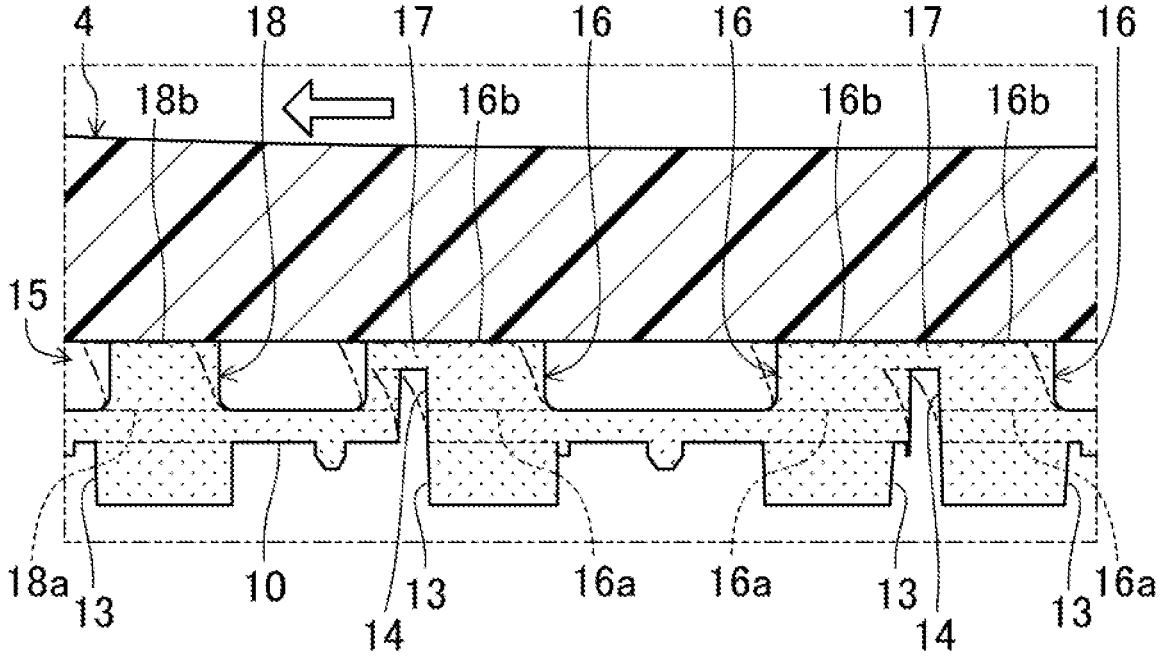
FIG. 10 is a view corresponding to FIG. 9 and schematically shows a state in which first columnar portions and second columnar portions are elastically deformed.

Each of the first columnar portions 16 is configured to be elastically deformable in the direction perpendicular to the thickness direction while maintaining the state in which the second end portion 16*b* is connected, together with the coupling portion 17, to the midsole 3 (the lower surface of the lower midsole portion 4) (see FIG. 10). This configuration enables smooth cutting maneuvers or the like, and can stabilize the stacking state in the sole structure 1.

First Variation of Embodiment

Figure 13:
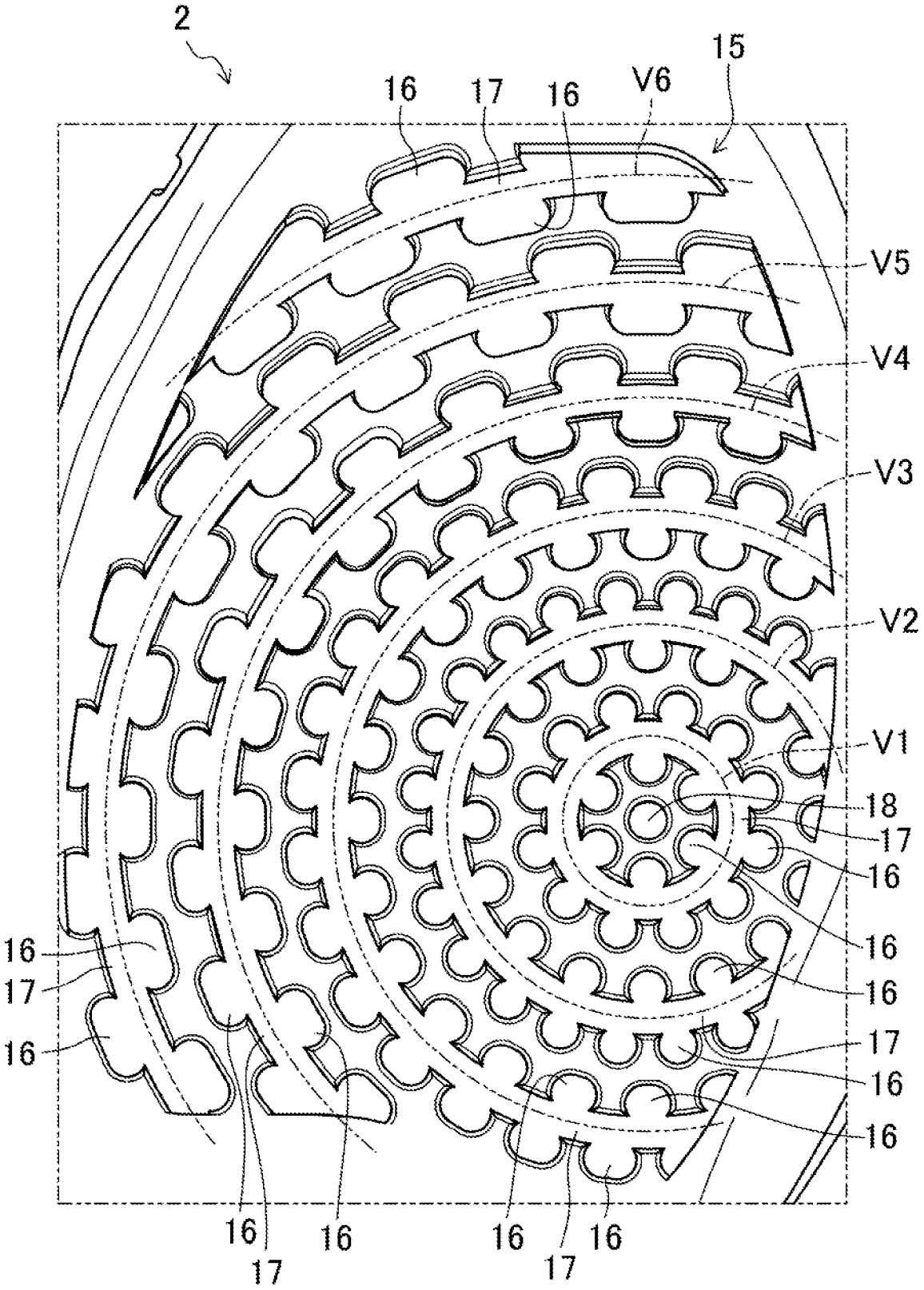
FIG. 13 is a view corresponding to FIG. 5 and shows an elastic structure in a first variation.

The above embodiment illustrates the elastic structure 15 having a plurality of second columnar portions 18, but is not limited thereto. That is, as in a first variation shown in FIG. 13, the elastic structure 15 may have one second columnar portion 18.

Specifically, this variation includes the first to sixth virtual lines V1 to V6. One second columnar portion 18 having a columnar shape is arranged at the center of the circle formed by the first virtual line V1. The second columnar portion 18 is arranged at a position in the sole structure 1 corresponding to the ball of the foot of the wearer in plan view. A plurality of first columnar portions 16 and a coupling portion 17 are arranged in the vicinity of each of the first to sixth virtual lines V1 to V6.

In such a variation, a large portion of the elastic structure 15 is formed by the plurality of first columnar portions 16 and the plurality of coupling portions 17. Thus, the connection region (the surface area) of the elastic structure 15 connected to the lower surface of the lower midsole portion 4 is larger than that in the above-described embodiment. As a result, the stacking state of the outsole 2 and the midsole 3 can be further stabilized. As a further variation of the first variation, the one second columnar portion 18 described above may be omitted.

Second and Third Variations of Embodiment

Figure 14:
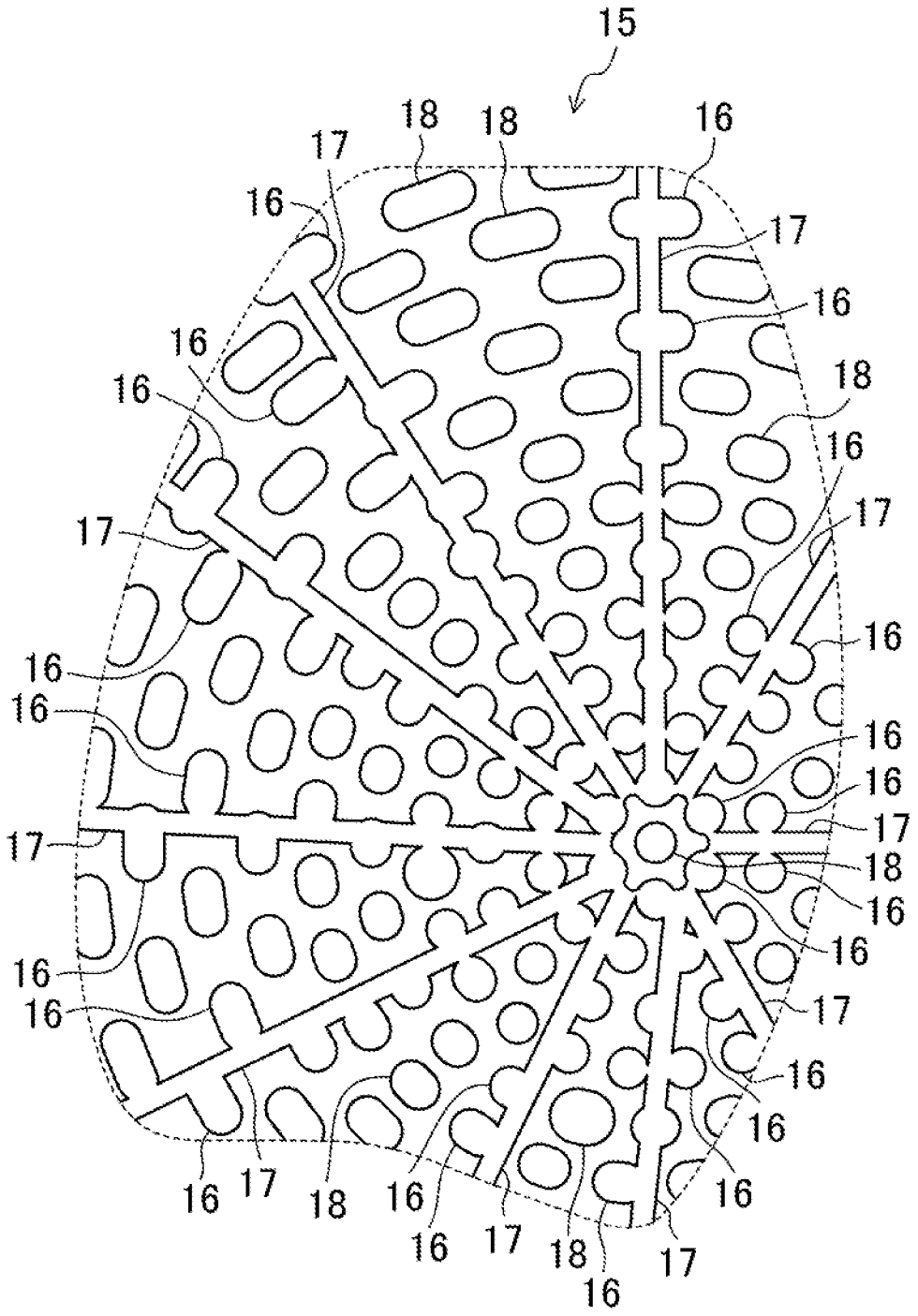
FIG. 14 is a view showing an elastic structure in a second variation.
Figure 15:
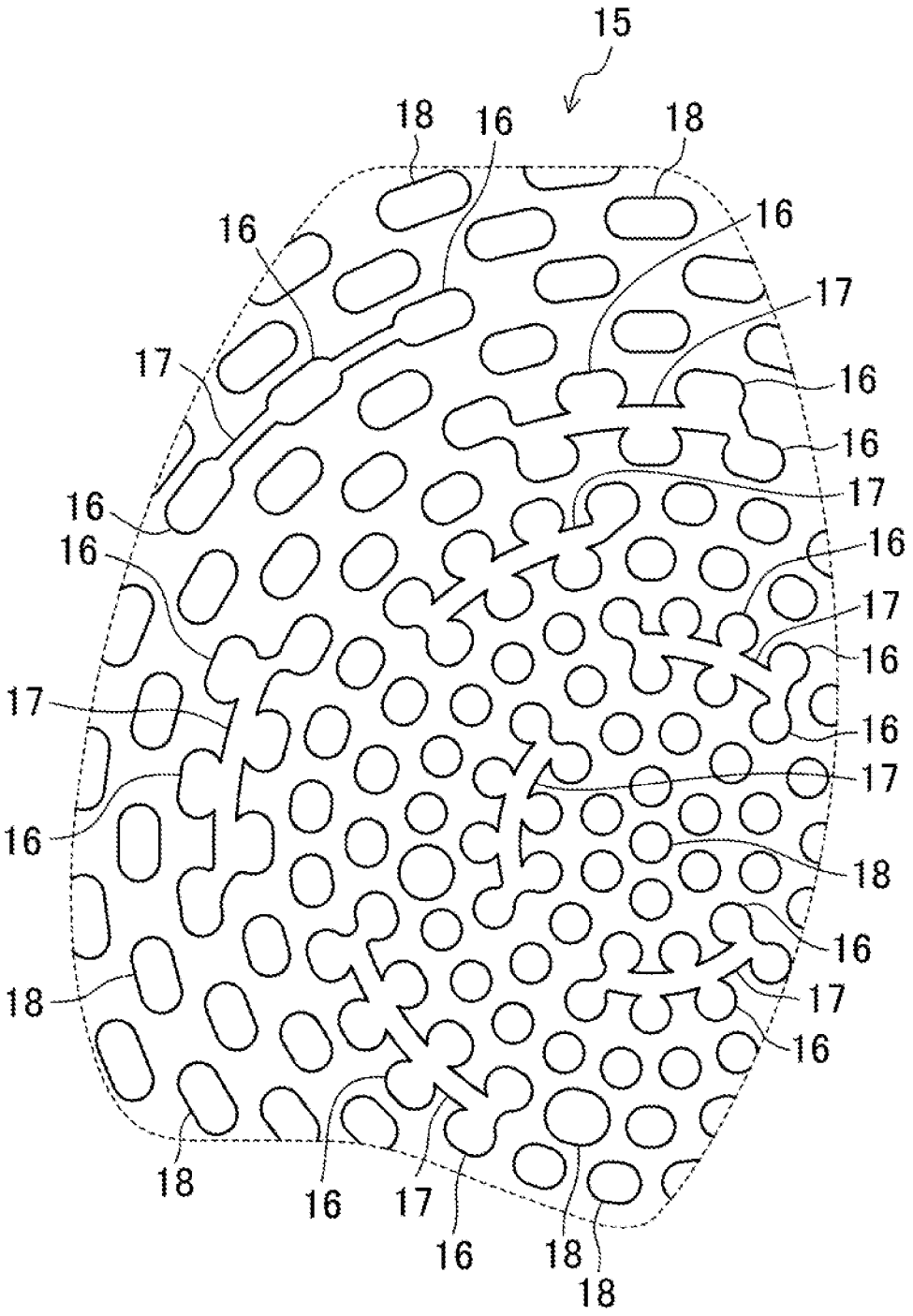
FIG. 15 is a view showing an elastic structure in a third variation.

The above-described embodiment illustrates that a plurality of coupling portions 17 is arranged concentrically, but is not limited thereto. For example, as in a second variation shown in FIG. 14, the coupling portions 17 may extend radially in a plurality of arbitrary directions from the position corresponding to the ball of the foot of the wearer. Alternatively, as in a third variation shown in FIG. 15, a plurality of coupling portions 17 each extending in an arbitrary direction from a predetermined position may be arranged randomly. The second and third variations, too, can provide the same or similar advantages to those of the above-described embodiment.

OTHER EMBODIMENTS

In the above-described embodiment, the outsole 2 corresponds to the "first sole portion" and the midsole 3 corresponds to the "second sole portion" as a non-limiting example. That is, the midsole 3 may correspond to the "first sole portion" and the outsole 2 may correspond to the "second sole portion" in another embodiment. That is, the elastic structure 15 may be formed integrally with the midsole 3 in another embodiment.

The above-described embodiment illustrates the elastic structure 15 including the plurality of coupling portions 17, but is not limited thereto. That is, the elastic structure 15 may be configured to include at least one coupling portion 17. Also in the configuration in which the elastic structure 15 includes one coupling portion 17, the second end portions 16*b*, 16*b* of the first columnar portions 16, 16 adjacent to each other and the one coupling portion 17 are integrally connected to the lower surface of the lower midsole portion 4. This configuration can stabilize the stacking state of the outsole 2 and the midsole 3, as described in the above embodiment.

The above-described embodiment illustrates that the plurality of first columnar portions 16 are positioned in the region in the sole structure 1 corresponding to the vicinity of the ball of the foot of the wearer, but is not limited thereto. That is, the elastic structure 15 may be configured such that at least one first columnar portion 16 is positioned in the region in the sole structure 1 corresponding to the vicinity of the ball of the foot of the wearer. This configuration, too, reduces the detachment of the elastic structure 15 from the midsole 3 at the position corresponding to the vicinity of the ball of the foot of the wearer, owing to the one first columnar portion 16 and the coupling portion 17 coupled to this first columnar portion 16, even if the shear stress is concentrated at the position corresponding to the vicinity of the ball of the foot of the wearer in the process of the cutting maneuvers or the like, as described in the above embodiment. As a result, the stacking state of the outsole 2 and the midsole 3 can be stabilized.

Although the embodiments of the present disclosure have been described above, the present disclosure is not limited to the above embodiments, and various modifications can be made within the scope of the present disclosure.

The present invention is industrially applicable to, for example, a sole structure of shoes for indoor sporting events, such as badminton and table tennis, and to shoes including the sole structure.

DESCRIPTION OF REFERENCE CHARACTERS

1 Sole Structure
2 Outsole
3 Midsole
4 Lower Midsole Portion
7 Upper Midsole Portion
10 Base Plate
12 Outer Wall Portion
13 Stud
14 Groove
15 Elastic Structure
16 First Columnar Portion
17 Coupling Portion
18 Second Columnar Portion

What is claimed is:

1. A sole structure for a shoe, comprising:

a first sole portion having a base plate; and a second sole portion having a lower surface facing an upper surface of the base plate, the second sole portion being stacked on the first sole portion in a thickness direction of the sole structure, the first sole portion having an elastic structure arranged between the base plate and the second sole portion in the thickness direction, the elastic structure having a plurality of elastically deformable first columnar portions each extending along the thickness direction and spaced apart from each other in a direction perpendicular to the thickness direction, wherein each of the plurality of first columnar portions is arranged concentrically about the portion of the sole structure configured to correspond to a ball of a foot of a wearer, and a plurality of coupling portions for coupling first columnar portions of the plurality of first columnar portions that are adjacent to each other, the plurality of coupling portions being arranged concentrically about the portion of the sole structure configured to correspond to the foot of the wearer, each coupling portion of the plurality of coupling portions having an annular or arc shape extending along a direction of extension of concentric circles about the portion of the sole structure, each of the plurality of first columnar portions having a first end portion formed integrally with the base plate and a second end portion connected to the second sole portion the plurality of first columnar portions being alternately arranged on inner and outer sides of corresponding coupling portions extending annularly in an arc shape, and the elastic structure being configured such that a coupling portion of the plurality of coupling portions couples the second end portions of the first columnar portions adjacent to each other, and that the second end portions are connected, together with the at least one coupling portion, to the second sole portion.

2. The sole structure of claim 1, wherein the first sole portion has at least one groove recessed in the first sole portion from a side opposite to a side facing the second sole portion to the side facing the second sole portion, and the plurality of coupling portions is arranged at a position corresponding to a bottom side of the at least one groove.

3. The sole structure of claim 1, wherein the elastic structure is arranged at a portion of the sole structure configured to correspond to a forefoot of the foot of the wearer, and at least one first columnar portion of the plurality of first columnar portions is positioned in a region of the sole structure configured to correspond to a vicinity of the ball of the foot of the wearer.

4. The sole structure of claim 1, wherein the elastic structure further includes a plurality of elastically deformable second columnar portions extending along the thickness direction and spaced apart from each other in a direction perpendicular to the thickness direction, and each of the plurality of second columnar portions has a first end portion formed integrally with the base plate and a second end portion connected to the second sole portion, and each of the plurality of second columnar portions is configured such that the second end portion is independently connected to the second sole portion.

5. The sole structure of claim 1, wherein the first sole portion is positioned on a side closer to a ground contact surface side of the sole structure with respect to the second sole portion.

6. The sole structure of claim 5, wherein the base plate has, at a peripheral edge portion thereof, an outer wall portion for closing a space between the base plate and the second sole portion from side of the sole structure.

7. The sole structure of claim 1, wherein each of the plurality of first columnar portions is elastically deformable in the direction perpendicular to the thickness direction while maintaining a state in which the second end portion is connected, together with the at least one coupling portion, to the second sole portion.

8. A shoe comprising the sole structure of claim 1.

9. A shoe comprising the sole structure of claim 2.

10. A shoe comprising the sole structure of claim 3.

11. A shoe comprising the sole structure of claim 4.

12. A shoe comprising the sole structure of claim 5.

13. A shoe comprising the sole structure of claim 6.

14. A shoe comprising the sole structure of claim 7.

* * * * *